US007178512B1

(12) United States Patent
Merten

(10) Patent No.: US 7,178,512 B1
(45) Date of Patent: Feb. 20, 2007

(54) FUEL SYSTEM FOR A MARINE VESSEL WITH A GASEOUS PURGE FUEL CONTAINER

(75) Inventor: Brian L. Merten, Mount Calvary, WI (US)

(73) Assignee: Brunswick Corporation, Lake Forest, IL (US)

( * ) Notice: Subject to any disclaimer, the term of this patent is extended or adjusted under 35 U.S.C. 154(b) by 309 days.

(21) Appl. No.: 10/874,781

(22) Filed: Jun. 23, 2004

(51) Int. Cl.
*F02M 37/20* (2006.01)
*F02M 37/10* (2006.01)
*F04D 9/00* (2006.01)

(52) U.S. Cl. ..... 123/516; 123/518; 137/197; 137/565.17; 137/565.3; 137/571

(58) Field of Classification Search ..... 137/197, 137/216, 565.17, 571, 565.3; 123/516, 518
See application file for complete search history.

(56) References Cited

U.S. PATENT DOCUMENTS 1,887,960 A * 11/1932 Sladky et al. ..... 137/571
2,986,162 A * 5/1961 Spexarth ..... 137/571
3,101,771 A * 8/1963 McCuen ..... 137/571
3,402,733 A * 9/1968 McAlvay ..... 137/197
3,696,799 A * 10/1972 Gauck ..... 123/518
3,763,887 A * 10/1973 MacVey et al. ..... 137/571
4,515,180 A * 5/1985 Napolitano ..... 137/565.17
4,732,131 A 3/1988 Hensel ..... 123/516
4,848,283 A 7/1989 Garms et al. ..... 123/73 AD
4,856,483 A 8/1989 Beavis et al. ..... 123/516
5,103,793 A 4/1992 Riese et al. ..... 123/516
5,263,459 A * 11/1993 Talaski ..... 123/516
5,372,116 A * 12/1994 Davis ..... 123/516
5,389,245 A 2/1995 Jaeger et al. ..... 210/129
5,832,903 A 11/1998 White et al. ..... 123/514
5,913,294 A * 6/1999 Takahashi et al. ..... 123/516
6,055,962 A 5/2000 Kirk ..... 123/516
6,253,742 B1 7/2001 Wickman et al. ..... 123/516
6,553,974 B1 4/2003 Wickman et al. ..... 123/516
6,694,955 B1 2/2004 Griffiths et al. ..... 123/516
6,718,953 B1 4/2004 Torgerud ..... 123/516
2004/0003796 A1* 1/2004 Nomura ..... 123/516
2004/0149266 A1* 8/2004 York et al. ..... 123/516

* cited by examiner

*Primary Examiner*—John Rivell
(74) *Attorney, Agent, or Firm*—William D. Lanyi

(57) ABSTRACT

A fuel container for a marine propulsion system is provided with a pump and a hose connected to an outlet of the pump and disposed within the cavity of the fuel container. The hose is provided with an opening, formed through its wall, through which a fluid can flow under certain circumstances. The opening is disposed in an ullage within the container and allows gaseous elements to be purged from the container when flow is induced from the container back to a fuel reservoir.

14 Claims, 5 Drawing Sheets

FUEL SYSTEM FOR A MARINE VESSEL WITH A GASEOUS PURGE FUEL CONTAINER

BACKGROUND OF THE INVENTION

1. Field of the Invention

The present invention relates generally to a fuel system for a marine vessel and, more particularly, to a fuel container, or fuel system module, in which a hose is provided with an opening to purge gas from an ullage in the fuel container.

2. Description of the Prior Art

U.S. Pat. No. 4,732,131, which issued to Hensel on Mar. 22, 1988, discloses a fuel line purging device. A fuel injection system is provided with a purging device for purging gas, including air and vapor, from a fuel system. The device includes a pressure responsive valve permitting gas to flow from an inlet connected to the high pressure fuel line to a vent outlet and blocking flow when gas has been purged from the system and fuel pressure rises.

U.S. Pat. No. 4,848,283, which issued to Garms et al. on Jul. 18, 1989, discloses a marine engine with combination vapor return, crankcase pressure, and cooled fuel line conduit. A marine propulsion system includes a two cycle water cooled crankcase compression internal combustion engine including a vapor separator, a remote fuel tank, and a fuel pump in the tank for delivering fuel to the engine in response to crankcase pulse pressure.

U.S. Pat. No. 4,856,483, which issued to Beavis et al. on Aug. 15, 1989, discloses a vacuum bleed and flow restrictor fitting for fuel injected engines with vapor separator. A fitting is provided in the vapor supply line. The fitting has a first reduced diameter passage providing a vacuum bleed orifice passage partially venting vacuum from the induction manifold to atmosphere, to limit peak vacuum applied to the vapor separator from the induction manifold.

U.S. Pat. No. 5,103,793, which issued to Riese et al. on Apr. 14, 1992, discloses a vapor separator for an internal combustion engine. The assembly includes a bowl member and a cover member. A fuel pump is located in the internal cavity of the bowl member and has its inlet located in the lower portion of the bowl member cavity for supplying fuel thereto. The fuel pump is secured in position within the bowl member by engagement of the cover member with the fuel pump.

U.S. Pat. No. 5,389,245, which issued to Jaeger et al. on Feb. 14, 1995, discloses a vapor separating unit for a fuel system. The unit has particular application to a fuel system for a marine engine. The vapor separating unit includes a closed tank having a fuel inlet through which fuel is fed to the tank by a diaphragm pump. The liquid level in the tank is controlled by a float-operated valve.

U.S. Pat. No. 5,832,903, which issued to White et al. on Nov. 10, 1998, discloses a fuel supply system for an internal combustion engine. The system has an electronically controlled fuel injection system and eliminates the need for a vapor separator. The system pumps an excessive amount of fuel through a plumbed fuel supply loop and cools recirculated fuel to cool all the components in the plumbed fuel supply loop.

U.S. Pat. No. 6,055,962, which issued to Kirk on May 2, 2000, discloses a fuel system for an internal combustion engine. The system uses a vacuum source to draw fuel from a fuel tank into a fuel reservoir. By avoiding the need for a fuel tank to pump fuel from the fuel tank to the fuel reservoir, a common incident of vapor lock is prevented. The vacuum is provided by a crankcase of a compressor.

U.S. Pat. No. 6,553,974, which issued to Wickman et al. on Apr. 29, 2003, discloses an engine fuel system with a fuel vapor separator and a fuel vapor vent canister. The system provides an additional fuel chamber, associated with a fuel vapor separator, that receives fuel vapor from a vent of the fuel vapor separator. In order to prevent the flow of liquid fuel into and out of the additional fuel chamber, a valve is provided which is able to block the vent of the additional chamber.

U.S. Pat. No. 6,694,955, which issued to Griffiths et al. on Feb. 24, 2004, discloses a marine engine with primary and secondary fuel reservoirs. The system comprises first and second fuel reservoirs connected in fluid communication with each other. The first fuel reservoir is a fuel vapor separator which has a vent conduit connected in fluid communication with a second fuel reservoir. Under normal operation, fuel vapor flows from the fuel vapor separator and into the second fuel reservoir for eventual discharge to the atmosphere.

U.S. Pat. No. 6,718,953, which issued to Torgerud on Apr. 13, 2004, discloses a fuel vapor separator with a flow directing component with a fuel recirculating flow path. The system provides first, second, and third reservoirs of a fuel vapor separator and first, second, and third pumps to cause fuel to be drawn from the fuel tank and provided to the combustion chambers of an internal combustion engine. A flow directing component is provided to inhibit recirculated fuel from mixing directly with fuel within the fuel vapor separator that has not yet been pumped to a fuel rail.

U.S. Pat. No. 6,253,742, which issued to Wickman et al. on Jul. 3, 2001, discloses a fuel supply method for a marine propulsion engine. The method uses a lift pump to transfer fuel from a remote tank to a vapor separator tank. Only one level sensor is provided in the vapor separator tank and an engine control unit monitors the total fuel usage subsequent to the most recent filling of the tank.

The patents described above are hereby expressly incorporated by reference in the description of the present invention.

As described above in the patents known to those skilled in the art, many different systems and methods have been provided to manage the flow of fuel from a fuel reservoir to an engine of a marine propulsion system. The flow management of both liquid fuel and vapors, both during operation of the marine engine and subsequent to its being turned off, is important in order to avoid various disadvantageous situations. It would therefore be significantly beneficial if a device could be provided which prevents unwanted flow of fuel to or from a fuel tank under circumstances when that unwanted flow of fuel could either be significantly disadvantageous to the proper operation of a marine vessel or, in certain applications, could create a dangerous situation.

SUMMARY OF THE INVENTION

A fuel system for a marine vessel, made in accordance with a preferred embodiment of the present invention, comprises a fuel container such as a fuel system module or fuel vapor separator. It also comprises a fuel pump having an inlet port and an outlet port, the inlet port being disposed within the fuel container. A hose is disposed within the fuel container. The hose has an inlet end and an outlet end. The inlet end is connected in fluid communication with the outlet of the fuel pump. An opening is formed through a portion of the hose. The opening provides fluid communication between a first region inside the cavity, or central portion of the hose, and a second region that is proximate an outside surface of the hose. In other words, the opening allows fluid flow through a wall of the hose. The fuel container is configured to contain liquid fuel, and under certain operational conditions, gaseous fuel in an ullage above the level of the liquid fuel in the fuel container. The opening in the hose is disposed within the ullage in a preferred embodiment of the present invention and can comprise a plurality of holes formed through the wall of the hose.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
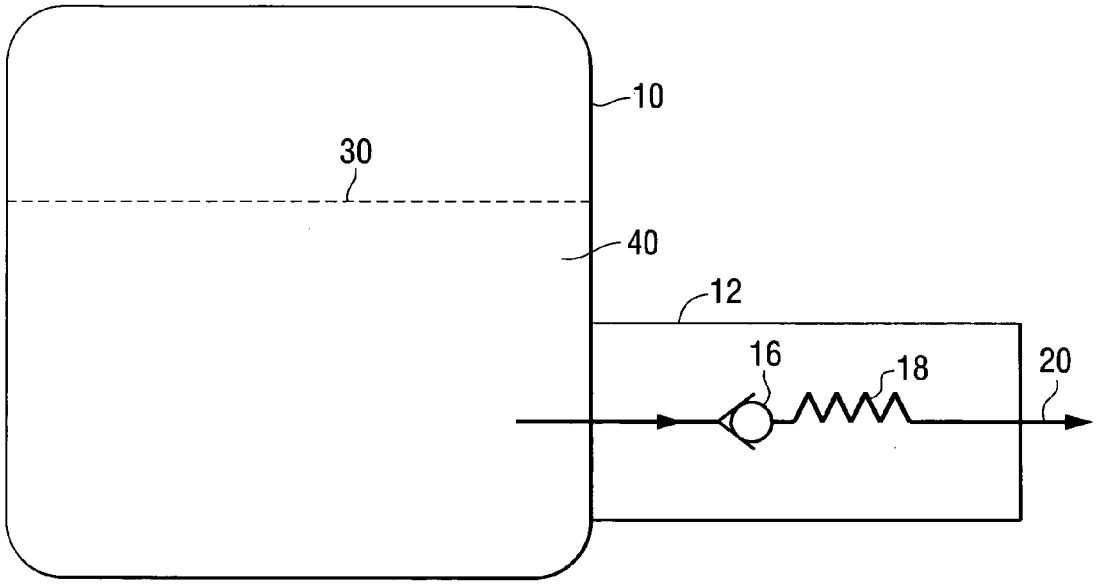
FIG. 1 PRIOR ART
FIG. 1 shows a fuel reservoir and a valve that is generally known to those skilled in the art.

Throughout the description of the preferred embodiment of the present invention, like components will be identified by like reference numerals.

FIG. 1 shows a system that is generally known to those skilled in the art. A fuel reservoir 10 contains a fuel supply for a marine vessel. An outlet of the fuel reservoir 10 is provided with a valve 12 which operates as a check valve. The check valve 16 operates to permit flow of fuel from the reservoir 10 to an engine of a marine propulsion system in the direction represented by the arrow heads in FIG. 1. It blocks the flow of fuel in the opposite direction from the fuel supply system of a marine propulsion engine back toward the fuel reservoir 10. Depending on the force provided by a resilient member of the check valve 16, represented by reference numeral 18, the check valve 16 can also inhibit the flow from the reservoir 10 if the conduit 20 is severed between the fuel reservoir 10 and the marine engine.

Figure 2:
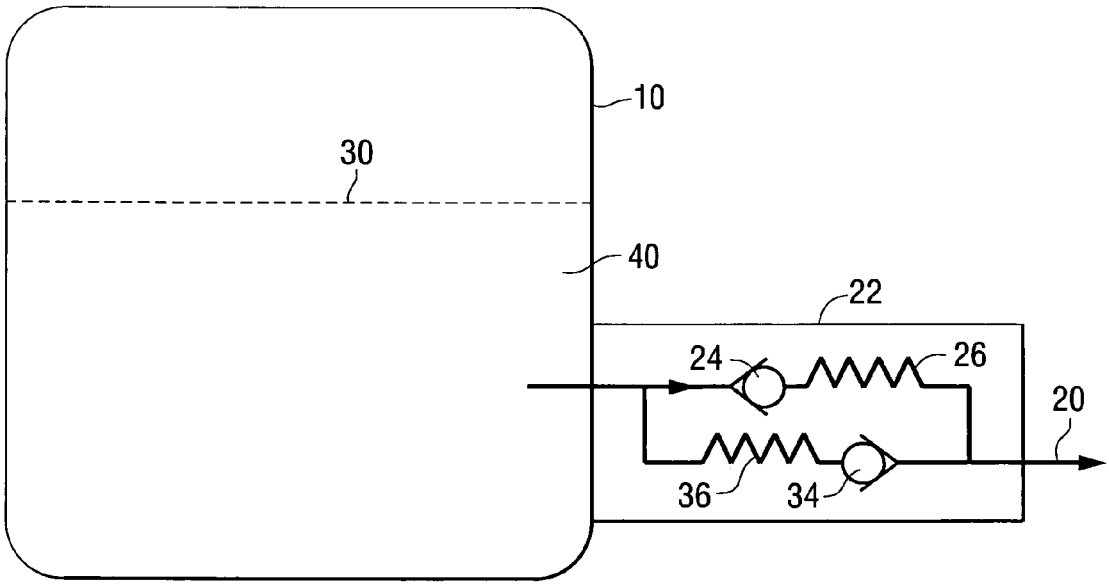
FIG. 2 shows a fuel reservoir and a valve made in accordance with a preferred embodiment of the present invention.

FIG. 2 shows a fuel reservoir 10 and a conduit 20 connected to the fuel reservoir. In FIG. 2, the valve 22 is different than the valve 12 described above in conjunction with FIG. 1 because of the structure of valve 22 which comprises a first check valve 24 and a second check valve 34 which are connected in parallel with each other. As can be seen in FIG. 2, the first and second check valves, 24 and 34, are connected in opposite directions. The first check valve 24 is configured to inhibit fluid flow in a direction from the conduit 20 toward the fuel reservoir 10. The second check valve 34 is configured to inhibit fluid flow in a direction from the fuel reservoir 10 toward the conduit 20. However, because of the force provided by the springs, 26 and 36, of the first and second check valves, 24 and 34, respectively, these two check valves also serve to inhibit fluid flow in the opposite directions when the differential pressure between their inlets and outlets are not greater than a preselected threshold. As an example, the first check valve 24 is configured to inhibit fluid flow in a direction from the fuel reservoir 10 toward the conduit 20 when a fluid pressure within the conduit 20 is greater than a first preselected threshold magnitude relative to a fluid pressure within the fuel reservoir 10. This preselected threshold magnitude is the pressure needed to provide sufficient force to overcome the force of the spring 26. The second check valve 34 is configured to inhibit fluid flow in a direction from the conduit 20 toward the fuel reservoir 10 when a fluid pressure within the reservoir 10 is greater than a second preselected threshold magnitude relative to a fluid pressure within the conduit. In other words, fluid can flow through the second check valve 34, from the conduit 20 toward the reservoir 10, only when the pressure in the conduit 20 is sufficiently high relative to the pressure within the reservoir 10 so that the force of spring 36 can be overcome. Dashed line 30 represents a fluid level of the liquid fuel 40 in the fuel reservoir 10 in FIGS. 1 and 2.

Figure 3:
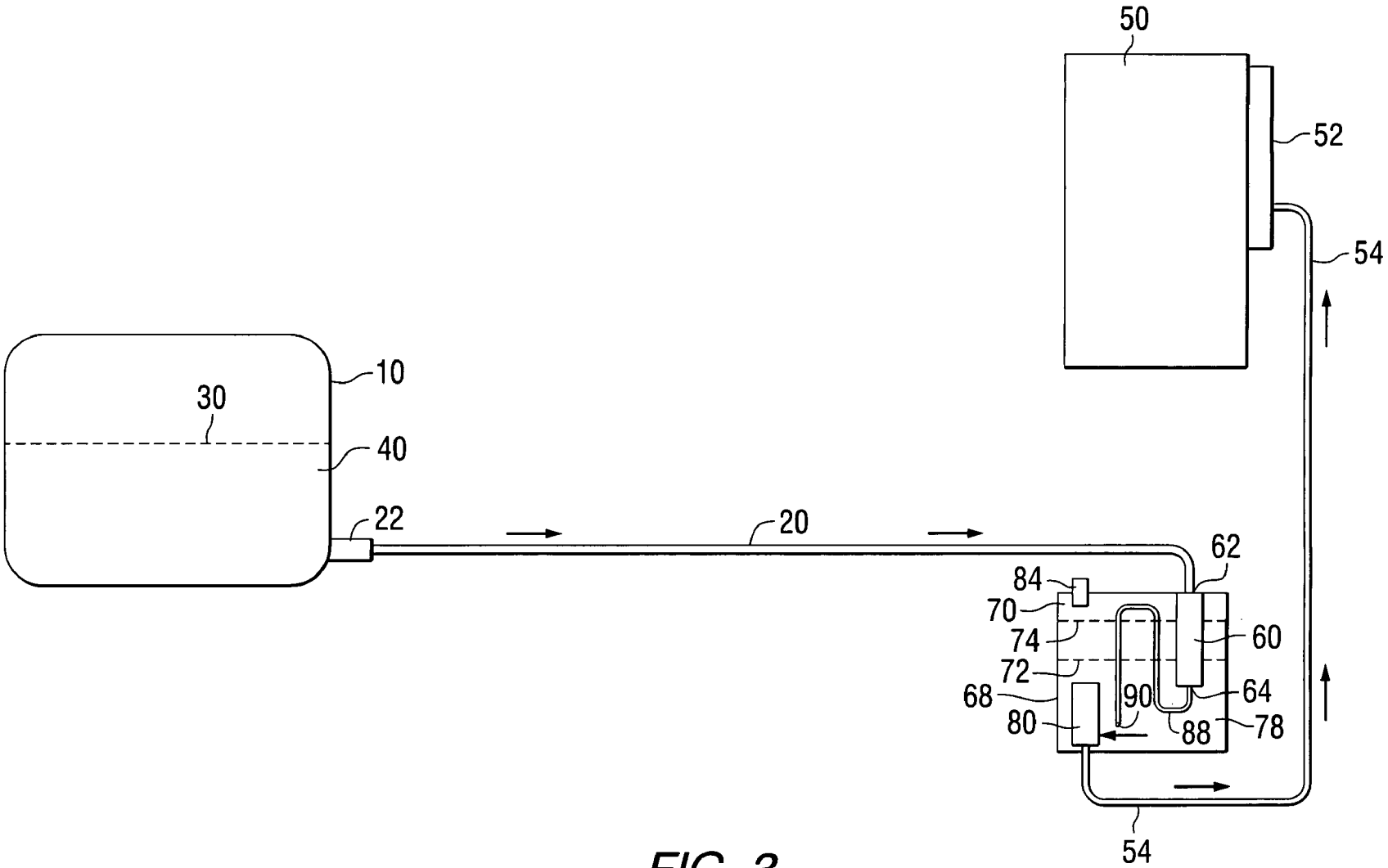
FIG. 3 shows a fuel system during normal operation of an engine.

FIG. 3 shows a fuel system for a marine engine 50 which is illustrated with a fuel rail 52 being provided with fuel from a fuel line 54. The system in FIG. 3 comprises a fuel pump 60 having an inlet port 62 and an outlet port 64. The inlet port 62 is connected in fluid communication with the conduit 20 described above in conjunction with FIG. 2. A fuel container 68, or fuel system module, is provided and the conduit 20 is connected in fluid communication between the fuel reservoir 10 and the fuel container 68. The fuel container 68 is configured to contain liquid fuel and, under certain circumstances, a gas 70 in an ullage located above the liquid fuel within the fuel container 68. Two dashed lines, 72 and 74, represent a minimum intended fuel level and a maximum intended fuel level, respectively. During operation of the engine 50, the liquid fuel 78 in the fuel container 68 is intended to vary between these two fuel levels, 72 and 74. Above the fuel level, a gas, such as gaseous fuel and air, is contained in an ullage which is identified by reference numeral 70 in FIG. 3. Fuel is pumped from the fuel reservoir 10 to the fuel container 68 by pump 60. The fuel is then pumped from the fuel container 68 to the fuel rail 52 by pump 80 which has an outlet connected to the fuel line 54. Also shown in FIG. 3 is a vent 84 which, in some applications and under certain circumstances, allows gas to escape from the ullage region 70 of the fuel container 68. However, as will be described in greater detail below, the fuel container 68 can be configured to have no vent 84. Also, even when a vent 84 is provided, certain circumstances and methods of operation may cause the vent 84 to be intentionally blocked. In these situations, the pressure within the fuel container 68 can be unvented.

With continued reference to FIG. 3, a hose 88 is disposed within the fuel container 68. The hose has an inlet end and an outlet end 90. The inlet end is connected in fluid communication with the outlet 64 of the fuel pump 60 as shown. The outlet end 90 is disposed below the lowest expected fuel level 72 within the fuel container 68. When pump 60 draws fuel from the fuel reservoir 10, it causes the fuel to flow through the hose 88- and out of the outlet end 90 to raise the fuel level in the fuel container 68. During normal operation of the marine propulsion system illustrated in FIG. 3, fuel flows in the directions represented by the arrows.

Figure 4:
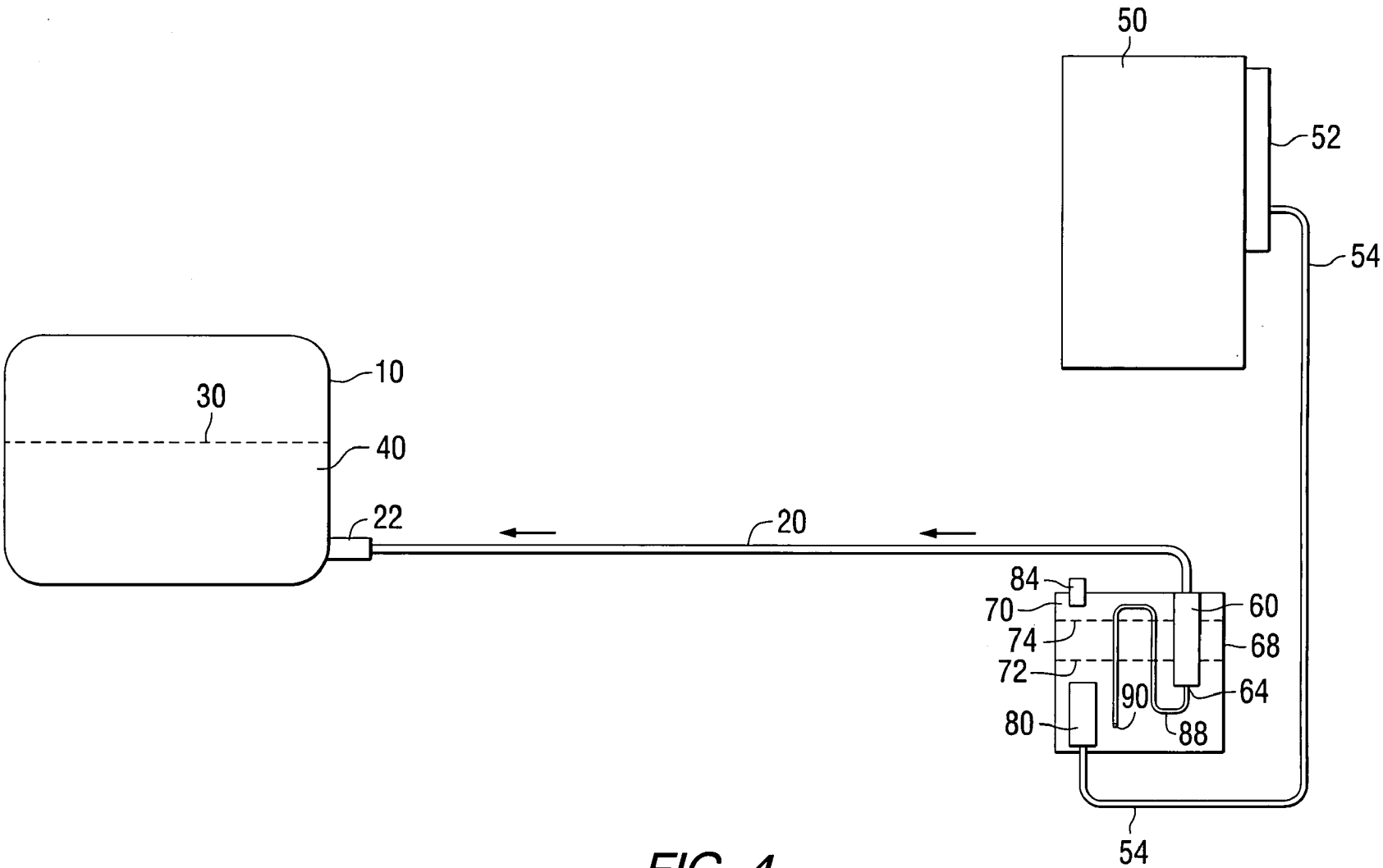
FIG. 4 shows the fuel system of FIG. 3 when the engine is turned off.

FIG. 4 shows the fuel system of FIG. 3, but when the engine 50 and pumps, 60 and 80, are inactive. When this occurs, the pressure within the fuel container 68 can exceed the pressure within the fuel reservoir 10. When this occurs, fuel can be forced to flow in the direction represented by the arrows, from the fuel container 68 toward the fuel reservoir 10. Several circumstances can lead to this direction of flow toward the fuel reservoir 10. First, the fuel container 68 might be located above the fuel reservoir 10. As a result, a pressure head will exist that will induce the flow in the direction represented by the arrow in FIG. 4. In addition, as discussed above, pressure can exist in the fuel container 68 that exceeds the pressure in the fuel reservoir 10, which is normally approximately equal to atmospheric pressure. If either or both of these circumstances exist, the fuel will flow from the fuel container 68 through the conduit 20 and toward the fuel reservoir 10. This pressure will cause liquid fuel to enter the outlet end 90 of the hose 88 and flow in a reverse direction through the pump 60 and into the conduit 20. Even though a gaseous ullage 70 exists, the pressure within the fuel container 68 can only cause liquid fuel to enter the hose 88 because of the position of the outlet end 90 below the liquid level, 72 and 74. The outlet end 90 is located below the liquid level to reduce the turbulence as fuel is pumped into the fuel container 68 by the pump 60.

With continued reference to FIG. 4, it should be understood that during normal operation of the engine 50, the pressure within the fuel container 68 can rise significantly above the pressure in the fuel reservoir 10, which is typically vented to atmospheric pressure. The pressure rise in the fuel container 68 can be the result of increasing temperature of the ambient surroundings, or the addition of fuel, by pump 60, into the fuel container. If the fuel container 68 is unvented, this pressure can reach magnitudes of approximately 15 psi above that of the pressure within the fuel reservoir 10.

With reference to FIGS. 2 and 4, the present invention provides the second check valve 34 so that the increased pressure within the fuel container 68 can be relieved when the engine 50 is turned off. Since the fuel reservoir 10 is at atmospheric pressure, the increased pressure in the fuel container 68 can force fuel through the hose 88 and pump 60 and through conduit 20 back to the fuel reservoir 10 when the engine 50 and pump 60 are inactive. The differential in pressure causes check valve 34 to open to allow this return flow, in the direction of the arrow shown in FIG. 4.

Figure 5:
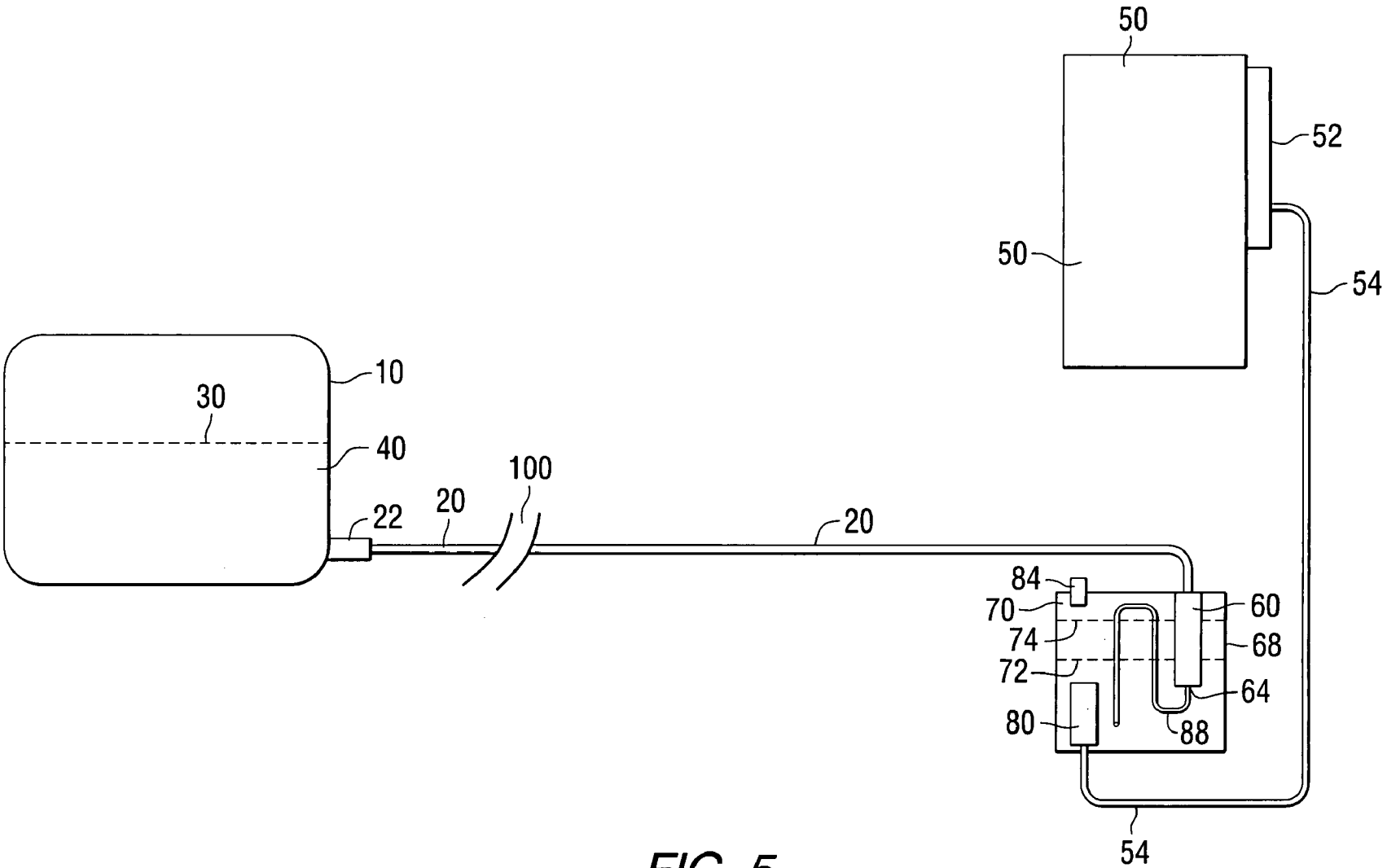
FIG. 5 illustrates a hypothetical break in a fuel conduit which is connected to the fuel reservoir.

FIG. 5 illustrates the system described above, but with a simulated break 100 shown in conduit 20. In the event that the conduit 20 is severed or forms a leak in its structure, the valve 22 prevents the contents of the fuel reservoir 10 from flowing out into the marine vessel. Flow through the second check valve 34 is prevented by the natural operation of the check valve which prevents flow in that direction from the reservoir 10. The first check valve 24 inhibits flow through it from the reservoir 10 unless the force of spring 26 is overcome. Since the pressure within the fuel reservoir 10 is typically at atmospheric pressure, the only way that the pressure can exceed the force of spring 26 is as a result of the pressure head between the height of valve 22 and the liquid level 30. In typical situations, this height within the fuel reservoir 10 is insufficient to create a significant pressure and a moderately sized spring 26 serves to prevent continued leakage through the break 100 in conduit 20.

Figure 6:
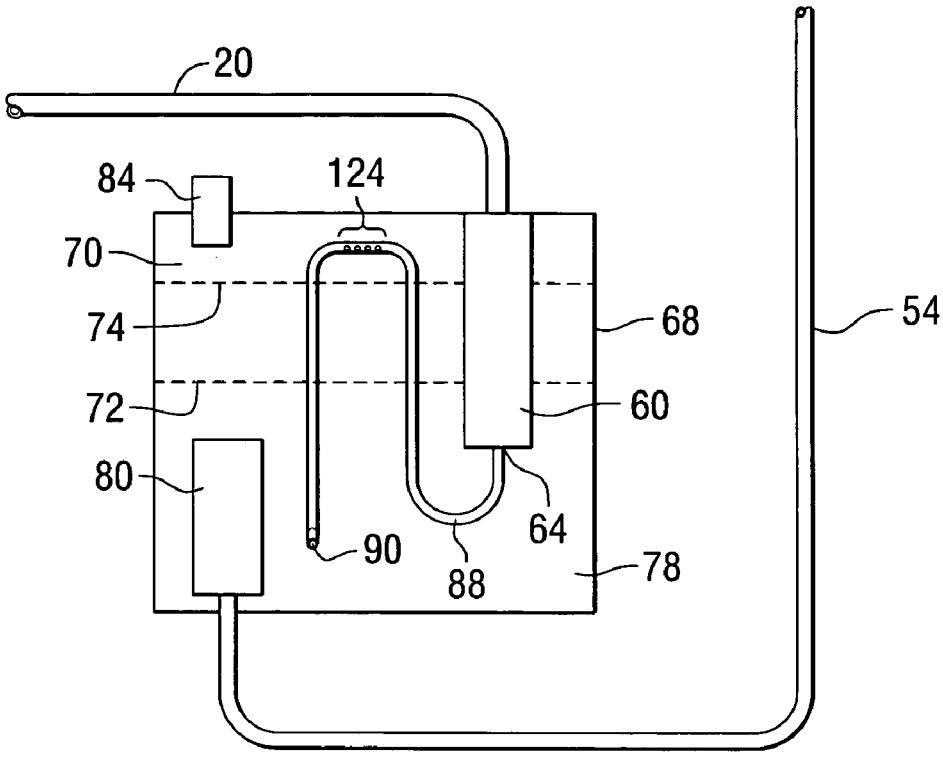
FIG. 6 shows a fuel container made in accordance with a preferred embodiment of the present invention.

FIG. 6 shows the fuel container 68 described above. When the engine is turned off, the pressure within the fuel container 68 will tend to induce a flow of fuel into the outlet end 90 of the hose 88, through the pump 60, and through conduit 20. However, since the outlet end 90 is below the lowest expected fuel level 72, liquid fuel, and not the gas in the ullage 70, would normally be purged from the fuel container 68. Since the existence of gas in the ullage 70 is not beneficial or advantageous to the operation of the fuel system, it would be beneficial if the gas in the ullage 70 could be purged rather than the liquid 78. This would also have the benefit of reducing the amount of liquid fuel 78 removed from the fuel container 68 during shutdown periods.

It should be understood that in certain automatic systems, such as the one described in U.S. Pat. No. 6,253,742, the specific location of the fuel level, between locations 72 and 74, is determined theoretically when the fuel level is below that of the maximum expected level at 74. Therefore, if the fuel level is caused to be lowered by the pressure in the fuel container 68 when the engine is inoperative, the engine control module may not be able to accurately determine when it is necessary to activate pump 60 to refill the fuel container 68. For this reason, it would be beneficial if the ullage 70 is first purged from the fuel container 68 prior to liquid fuel 78 being caused to flow through conduit 20 back to the fuel reservoir 10.

Figure 7:
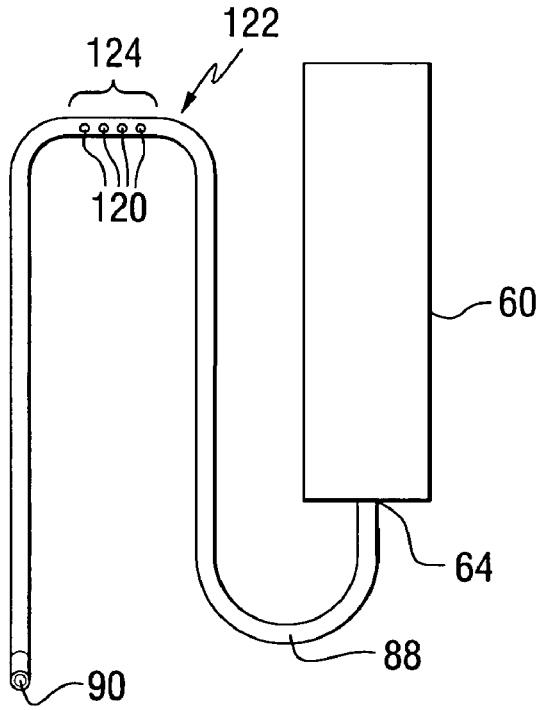
FIG. 7 shows an enlarged view of a hose associated with a pump within the fuel container illustrated in FIG. 6.

FIG. 7 shows an adaptation to the fuel system which causes the ullage 70 to be purged prior to the liquid fuel 78 in the fuel container 68. With reference to FIGS. 6 and 7, small holes 120 are provided in the hose 88 at a region of the hose that is within the ullage 70 of the fuel container 68. This opening 124, which can comprise a plurality of holes 120, is formed through a portion 122 of the hose 88. The opening 124 provides fluid communication between a first region inside a cavity of the hose and a second region proximate an outside surface of the hose. In other words, the portion 122 with the opening 124 allows fluid to flow through the thickness of the wall of the hose 88. The portion 122 is disposed in the ullage 70, as illustrated in FIG. 6, so that when the engine is turned off, and pump 60 is inactive, the gas in the ullage 70 is the first fluid to be caused to flow in a reverse direction through hose 88 and pump 60 toward the conduit 20. As a result, when the engine 50 is turned off, the ullage 70 is the first portion of the fuel container 68 that is purged back toward the fuel reservoir 10. Although liquid fuel 78 may later be purged in this manner, depending on the relative pressures of the fuel reservoir 10 and fuel container 68, the liquid fuel 78 is not purged prior to the gas in the ullage 70 and the lowering effect on the fuel level in the fuel container 68 is lessened.

As described above in conjunction with FIGS. 2–7, a fuel system made in accordance with the present invention comprises a fuel container 68 and a fuel pump 60 which has an inlet port 62 and an outlet port 64, with the inlet port 62 being disposed within the fuel container 68. A hose 88 is disposed within the fuel container 68 and has an inlet end and an outlet end 90. The inlet end is connected in fluid communication with the outlet 64 of the fuel pump 60. An opening 124 is formed through a portion 122 of the hose 88. The opening 124 provides fluid communication between a first region within a cavity of the hose, such as the internal cylindrical cavity of the hose, and a second region proximate an outside surface of the hose 88. The fuel container 68 is configured to contain liquid fuel and, in certain circumstances, gaseous fuel in an ullage 70. The opening 124 is disposed within the portion of the container 68 in which the ullage 70 is expected to exist. A conduit 20 is connected in fluid communication with the inlet port of the pump 60. A fuel reservoir 10, such as a fuel tank of the marine vessel, is connected in fluid communication with the inlet port of the pump 60. The opening 124 can comprise a plurality of holes 120, in which each of the holes 120 is approximately 0.040 inches in diameter. In a preferred embodiment, the holes 120 are provided on an inside radius of a bend in the hose 88.

The fuel system comprises a conduit 20 connected to a fuel reservoir 10 with a valve 22 connected in fluid communication with the conduit 20. The valve comprises a first check valve 24 and a second check valve 34. Each of the check valves is configured to inhibit flow in a particular direction.

Although the present invention has been described in particular detail and illustrated to show preferred embodiments, it should be understood that alternative embodiments are also within its scope.

I claim:

1. A fuel system of a marine vessel, comprising:

a fuel container configured to contain liquid fuel and to contain an ullage above the level of the liquid fuel;

a fuel pump in said fuel container and having an inlet port and an outlet port;

a hose disposed within said fuel container, said hose having an inlet end and an outlet end, said inlet end being connected in fluid communication with said outlet port of said fuel pump, said hose having first, second, and third serially connected portions, said first portion extending from said inlet end of said hose to said second portion and receiving liquid fuel from said outlet port of said fuel pump, said second portion extending from said first portion to said third portion, said third portion extending from said second portion to said outlet end of said hose and supplying liquid fuel to said fuel container, such that liquid fuel flows serially from said first portion then to said second portion then to said third portion, said second portion being in said ullage; and an opening formed through said second portion of said hose, said opening providing fluid communication between a first region within a cavity of said hose and a second region proximate an outside surface of said hose.

2. The fuel system of claim 1, wherein:

said first portion of said hose extends below the level of liquid fuel in said fuel container.

3. The fuel system of claim 1, wherein:

said third portion of said hose extends below the level of liquid fuel in said fuel container.

4. The fuel system of claim 3, wherein:

said outlet end of said hose is below the level of liquid fuel in said fuel container.

5. The fuel system of claim 1, further comprising:

a conduit connected in fluid communication with said inlet port of said pump.

6. The fuel system of claim 5, further comprising:

a fuel reservoir connected in fluid communication with said inlet port of said pump.

7. The fuel system of claim 1, wherein:

said opening comprises a plurality of holes formed through a wall of said hose.

8. A fuel system of a marine vessel, comprising:

a fuel container, said fuel container being configured to contain liquid fuel and an ullage above a level of said liquid fuel;

a first fuel pump in said fuel container and having an inlet port and an outlet port;

a hose disposed within said fuel container, said hose having an inlet end and an outlet end, said inlet end being connected in fluid communication with said outlet port of said first fuel pump, said outlet end supplying liquid fuel to said fuel container;

an opening formed through a portion of said hose, said opening providing fluid communication between a first region within a cavity of said hose and a second region proximate an outside surface of said hose;

a second fuel pump in said fuel container and receiving liquid fuel from said outlet end of said hose and pumping the liquid fuel externally of said fuel container through a fuel line to a marine engine.

9. The fuel system of claim 8, wherein:

said opening is disposed within said ullage.

10. The fuel system of claim 9, further comprising:

a conduit connected in fluid communication with said inlet port of said pump.

11. A fuel system of a marine vessel, comprising:

a fuel container, said fuel container being configured to contain liquid fuel and an ullage above a level of said liquid fuel;

a first fuel pump in said fuel container and having an inlet port and an outlet port;

a hose disposed within said fuel container, said hose having an inlet end and an outlet end, said inlet end being connected in fluid communication with said outlet port of said first fuel pump said hose having first, second, and third serially connected portions, said first portion extending from said inlet end of said hose to said second portion and receiving liquid fuel from said outlet port of said first fuel pump, said second portion extending from said first portion to said third portion, said third portion extending from said second portion to said outlet end of said hose and supplying liquid fuel to said fuel container, such that liquid fuel flows serially from said first portion then to said second portion then to said third portion, said second portion being in said ullage, said first portion extending below the level of liquid fuel in said fuel container, said third portion extending below the level of liquid fuel in said fuel container, said outlet end of said hose being below the level of liquid fuel in said fuel container;

an opening formed through a said second portion of said hose, said opening providing fluid communication between a first region within a cavity of said hose and a second region proximate an outside surface of said hose; and a conduit connected in fluid communication with said inlet port of said first fuel pump.

12. The fuel system of claim 11, further comprising:

a fuel reservoir connected in fluid communication with said inlet port of said pump.

13. The fuel system of claim 11, comprising:

a second fuel pump in said fuel container and receiving liquid fuel from said outlet end of said hose and pumping the liquid fuel externally of said fuel container through a fuel line to a marine engine.

14. The fuel system of claim 11, wherein:

said opening comprises a plurality of holes formed through a wall of said hose.

* * * * *